US010944199B2

(12) United States Patent
Matsuura

(10) Patent No.: US 10,944,199 B2
(45) Date of Patent: Mar. 9, 2021

(54) CONNECTOR WITH TERMINAL FITTING HAVING STABILIZER AND RATTLING PREVENTING PROTRUSION ON OPPOSITE SURFACES

(71) Applicant: Sumitomo Wiring Systems, Ltd., Mie (JP)

(72) Inventor: Junya Matsuura, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/668,102

(22) Filed: Oct. 30, 2019

(65) Prior Publication Data

US 2020/0144755 A1 May 7, 2020

(30) Foreign Application Priority Data

Nov. 2, 2018 (JP) ..... JP2018-207013

(51) Int. Cl.

| | |
|---|---|
| ***H01R 13/436*** | (2006.01) |
| ***H01R 13/533*** | (2006.01) |
| ***H01R 13/422*** | (2006.01) |
| ***H01R 13/629*** | (2006.01) |
| ***H01R 13/639*** | (2006.01) |
| ***H01R 13/502*** | (2006.01) |

(52) U.S. Cl.

CPC ..... *H01R 13/4365* (2013.01); *H01R 13/422* (2013.01); *H01R 13/502* (2013.01); *H01R 13/533* (2013.01); *H01R 13/629* (2013.01); *H01R 13/639* (2013.01)

(58) Field of Classification Search

CPC ..... H01R 13/514

See application file for complete search history.

(56) References Cited

U.S. PATENT DOCUMENTS

| | | | | |
|---|---|---|---|---|
| 6,227,915 | B1 * | 5/2001 | Sakatani | H01R 13/11 439/752.5 |
| 6,244,897 | B1 * | 6/2001 | Shinozaki | H01R 13/5208 439/587 |
| 6,264,507 | B1 * | 7/2001 | Fukamachi | H01R 13/4367 439/752 |
| 7,101,233 | B2 * | 9/2006 | Maeda | H01R 13/11 439/852 |

(Continued)

FOREIGN PATENT DOCUMENTS

JP 2014-216256 11/2014

*Primary Examiner* — Abdullah A Riyami
*Assistant Examiner* — Nader J Alhawamdeh
(74) *Attorney, Agent, or Firm* — Gerald E. Hespos; Michael J. Porco; Matthew T. Hespos

(57) ABSTRACT

A terminal fitting (60) includes a stabilizer (65) arranged on a first surface of a body (61) and configured to enter a guide groove (23) if the terminal fitting is in a proper insertion posture while restricting insertion by contacting a contact surface (24B) if the terminal fitting (60) is in an inverted insertion posture opposite to the proper insertion posture. The terminal fitting (60) includes a rattling preventing protrusion (66) arranged on a second surface of the body (61) opposite to the first surface and at a position overlapping the stabilizer (65) in a front-rear direction and capable of contacting facing upper wall surfaces (27) of a cavity (21) with the terminal fitting held in the inverted insertion posture and the stabilizer (65) held in contact with the contact surface (24B).

14 Claims, 10 Drawing Sheets

(56) References Cited

U.S. PATENT DOCUMENTS

| | | | | |
|---|---|---|---|---|
| 8,348,707 | B2 * | 1/2013 | Ishikawa | H01R 13/055<br>439/744 |
| 8,506,328 | B2 * | 8/2013 | Mizutani | H01R 13/113<br>439/595 |
| 8,784,141 | B2 * | 7/2014 | Ishikawa | H01R 43/20<br>439/595 |
| 10,069,233 | B2 * | 9/2018 | Goto | H01R 13/4223 |
| 2005/0101198 | A1 * | 5/2005 | Maeda | H01R 13/11<br>439/852 |

* cited by examiner

CONNECTOR WITH TERMINAL FITTING HAVING STABILIZER AND RATTLING PREVENTING PROTRUSION ON OPPOSITE SURFACES

BACKGROUND

Field of the Invention

The invention relates to a connector.

Related Art

Japanese Unexamined Patent Publication No. 2014-216256 discloses a connector with a female terminal fitting and a housing for accommodating the female terminal fitting. The housing includes a terminal accommodation hole, a terminal locking lance for retaining the female terminal fitting in the terminal accommodation hole, and terminal locking grooves extending along an inserting direction of the female terminal fitting. The female terminal fitting includes rattling preventing projections that engage the terminal locking grooves for restricting movement of the female terminal fitting in a direction perpendicular to the inserting direction. The female terminal fitting may be inverted during insertion into the terminal accommodation hole. In this case, the rattling preventing projections contact walls that are narrower than the terminal locking grooves to restrict further insertion.

The connector of Japanese Unexamined Patent Publication No. 2014-216256 has the rattling preventing projections on left and right surfaces in addition to the terminal locking lance on the upper surface of the female terminal fitting. Thus, this connector is larger in the direction perpendicular to the inserting direction of the female terminal fitting. Further, this connector is configured such that the rattling preventing projections contact walls lateral to the terminal accommodation hole if the female terminal fitting is inverted. Thus, the female terminal fitting may be inclined in a vertical direction with the rattling preventing projections held in contact with the walls of the terminal accommodation hole. In this case, the inverted insertion posture of the female terminal fitting is not stable and inverted insertion cannot be prevented stably. Thus, there is a need for a terminal fitting that can be miniaturized while stably preventing inverted insertion.

The invention was completed on the basis of the above situation and aims to provide a connector capable of effectively restricting inverted insertion of a terminal into a housing and realizing miniaturization.

SUMMARY

The invention is directed to a connector with a housing that includes a cavity extending in a front-rear direction. A guide groove communicates with the cavity and extends in the front-rear direction. Additionally, a stepped contact surface is formed on an inner surface of the cavity and on a side opposite the guide groove. The connector further includes a terminal fitting that can be inserted into the cavity. The terminal fitting includes a body with a stabilizer on one surface of a body. The stabilizer is configured to enter the guide groove if the terminal fitting is in a proper insertion posture. However, the stabilizer contacts the contact surface to restrict further insertion if the terminal fitting is in an inverted insertion posture. A rattling preventing protrusion is arranged on a surface of the body opposite to the surface with the stabilizer and at a position overlapping the stabilizer in the front-rear direction. If the terminal fitting is in the inverted insertion posture, the rattling preventing protrusion contacts a facing wall surface of the cavity while the stabilizer is in contact with the contact surface.

The rattling preventing protrusion is on the surface of the body opposite to the stabilizer and at the position overlapping the stabilizer in the front-rear direction. The stabilizer of the inverted terminal fitting is held in contact with the contact surface, and, simultaneously, the rattling preventing protrusion contacts the facing wall surface of the cavity. The contact between the rattling preventing protrusion and the wall surface of the cavity prevents the terminal fitting from being inclined in the cavity with respect to the front-rear direction. Thus, a state where the stabilizer is in contact with the contact surface can be maintained and the inverted insertion of the terminal fitting is restricted. Further, the rattling preventing protrusion is on the surface of the body opposite the surface with the stabilizer. Parts for preventing inverted insertion need not be provided on a surface different from those where the rattling preventing protrusion and the stabilizer are arranged, and there is no size increase in a direction perpendicular to the front-rear direction. Therefore, the connector can restrict inverted insertion of the terminal fitting into the housing and achieve miniaturization.

The terminal fitting may include a second rattling preventing protrusion arranged in front of and spaced from the rattling preventing protrusion on the other surface of the body for contacting the facing wall surface of the cavity with the terminal fitting held in the inverted insertion posture and the stabilizer held in contact with the contact surface. Accordingly, the two rattling preventing protrusions can contact the wall surface of the cavity at positions different in the front-rear direction for further preventing the terminal fitting from being inclined with respect to the front-rear direction in the cavity. In this way, the state where the stabilizer is in contact with the contact surface can be maintained reliably and the inverted insertion of the terminal fitting is restricted even more effectively.

The housing may include a locking lance configured to retain and lock the terminal fitting by deflectably projecting into the cavity, and the second rattling preventing protrusion may be retainable and lockable by the locking lance if the terminal fitting is in the proper insertion posture. According to this configuration, the second rattling preventing protrusion functions to restrict inverted insertion of the terminal fitting and also to prevent escape of the terminal fitting. Thus, the configuration of the connector can be simplified as compared to the case where such functions are exhibited by different mechanisms.

The housing may have a second contact surface capable of contacting a front end of the terminal fitting and restricting a forward movement of the terminal fitting that is in the inverted insertion posture. The two contact surfaces connector reliably prevent the insertion of the terminal fitting in the inverted insertion posture.

DETAILED DESCRIPTION

An embodiment of the invention is described with reference to FIGS. 1 to 10. Note that, in the following description, a left side and a right side in FIGS. 3, 4, 6, 9 and 10 are defined as a front side and a rear side concerning a front-rear direction. A vertical direction is based on a vertical direction in each of FIGS. 3, 4, 5, 9 and 10. Sides in front of and behind the plane of each of FIGS. 3, 4, 9 and 10 are defined as a left side and a right side concerning a lateral direction.

Figure 1:
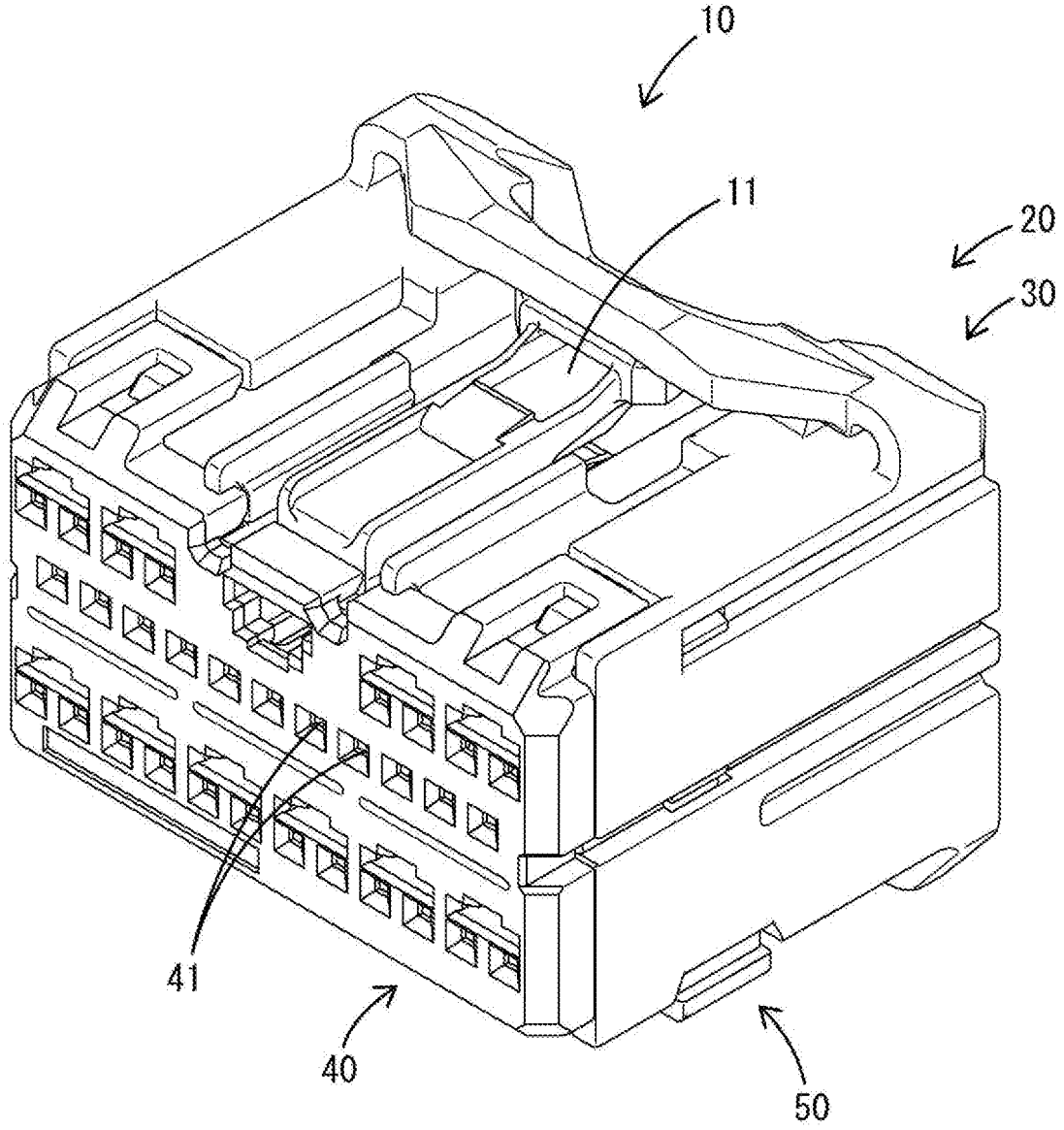
FIG. 1 is a perspective view of a connector of one embodiment viewed obliquely from a front-upper side.
Figure 9:
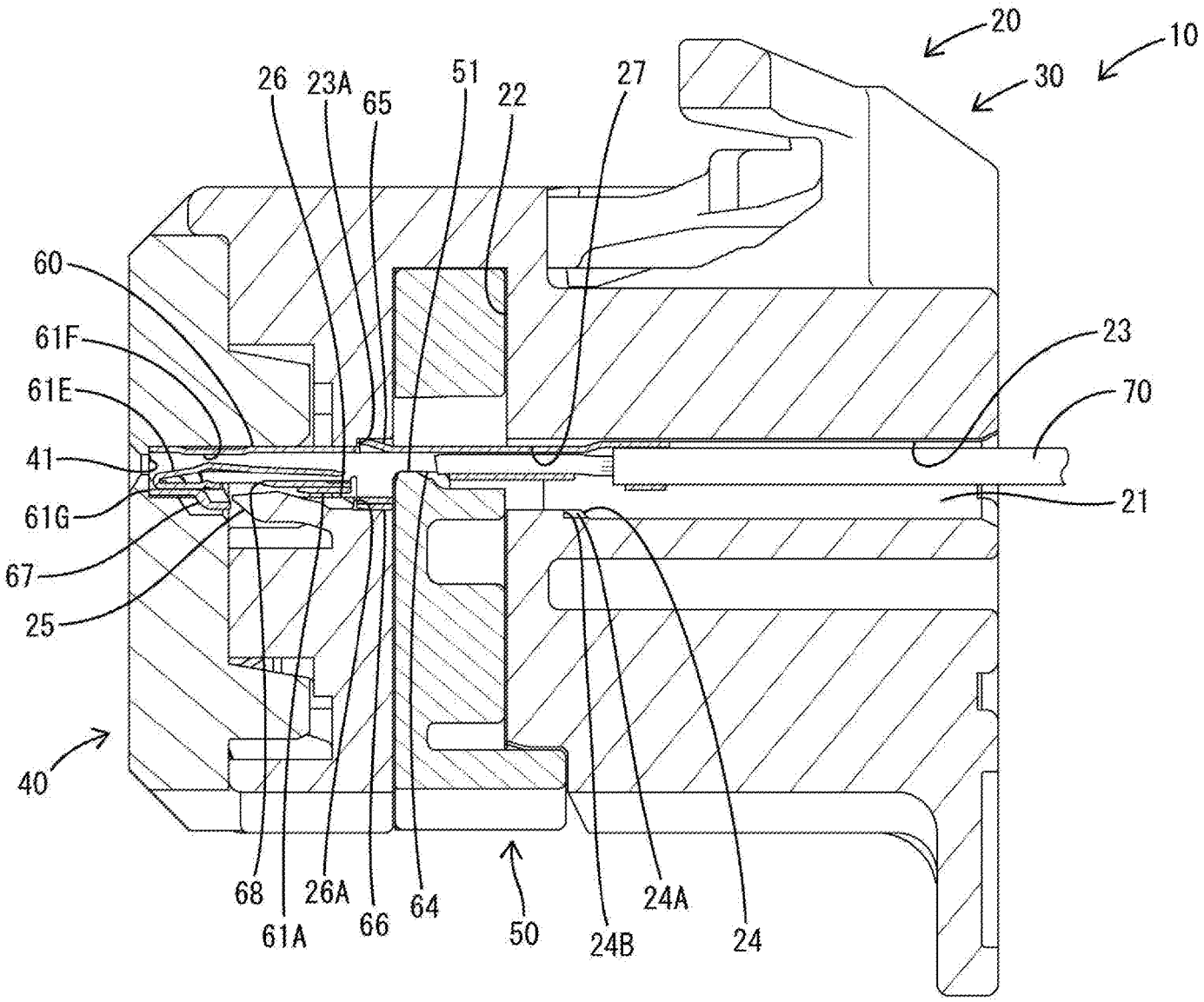
FIG. 9 is a right side view in section showing a state where the terminal fitting is mounted in a proper insertion posture in a cavity.

A connector 10 of this embodiment shown in FIG. 1 may be part of wiring harness of an automotive vehicle. As shown in FIG. 9, the connector 10 includes a housing 20 and terminal fittings 60 to be accommodated into the housing 20.

Figure 3:
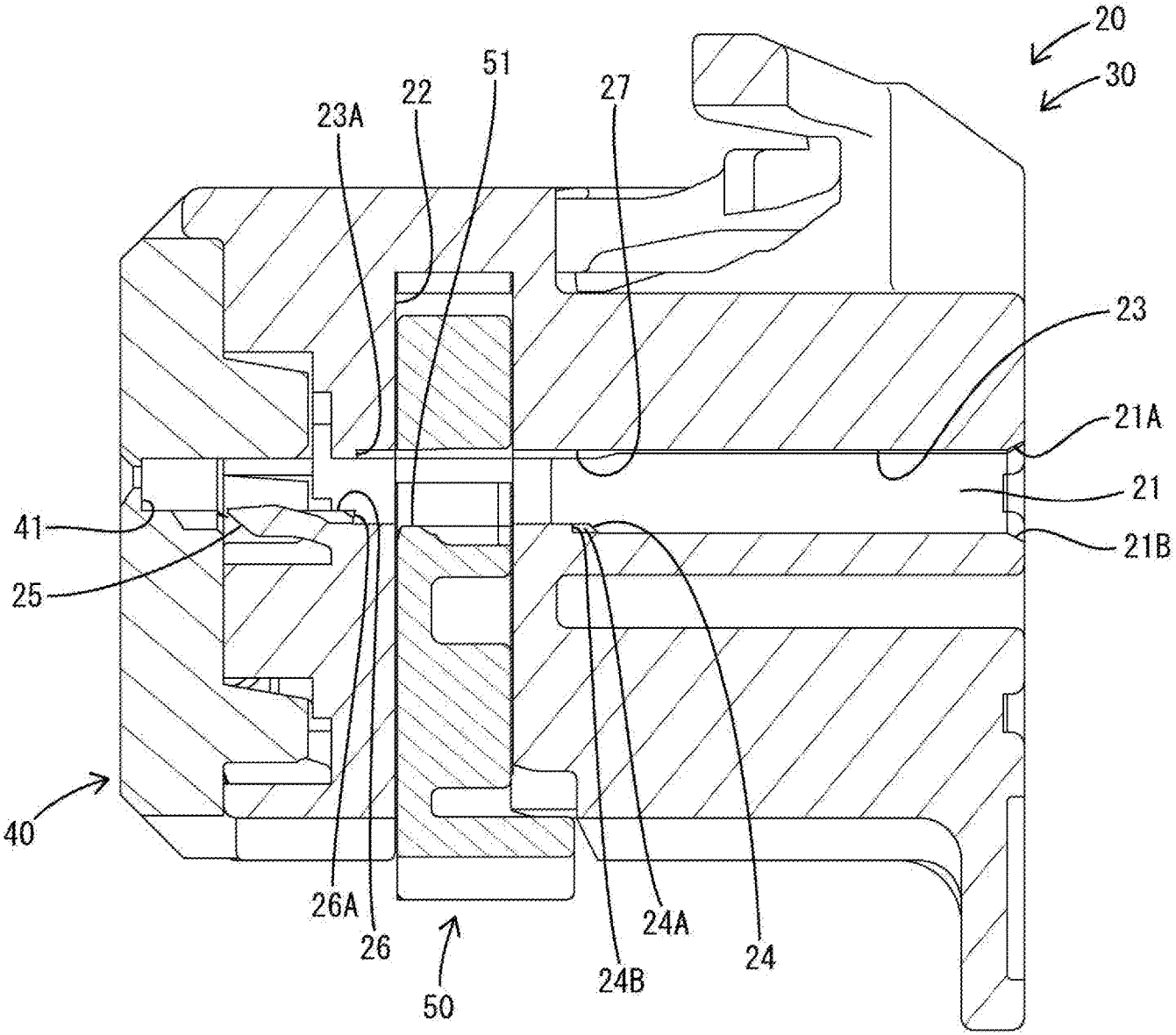
FIG. 3 is a side view in section of the connector.

The housing 20 is a female housing made of synthetic resin. As shown in FIG. 1, the housing 20 has a resiliently deflectable lock arm 11 to be locked to a mating connector. As shown in FIG. 3, the housing 20 also includes a housing body 30, a front mask 40 and a retainer 50. The retainer 50 is assembled with the housing body 30 by being fit into a retainer fitting groove 22 to be described later. The front mask 40 is in the form of a flat plate having a thickness in the front-rear direction, and is assembled with the housing body 30 to cover the front end of the housing body 30.

As shown in FIG. 3, the housing body 30 includes cavities 21, a retainer fitting groove 22, guide grooves 23, steps 24, entrance grooves 24A, first contact surfaces 24B, locking lances 25 and second contact surfaces 26A. The cavities 21 penetrate through the housing 20 in the front-rear direction and the terminal fittings 60 are insertable into the cavities 21. As shown in FIG. 1, the cavities 21 are aligned in the lateral direction in each of three stages divided in the vertical direction. The retainer fitting groove 22 is open downward at a position near a front of the housing body 30 in the front-rear direction, as shown in FIG. 3, and extends vertically to intersect the cavities 21.

Figure 2:
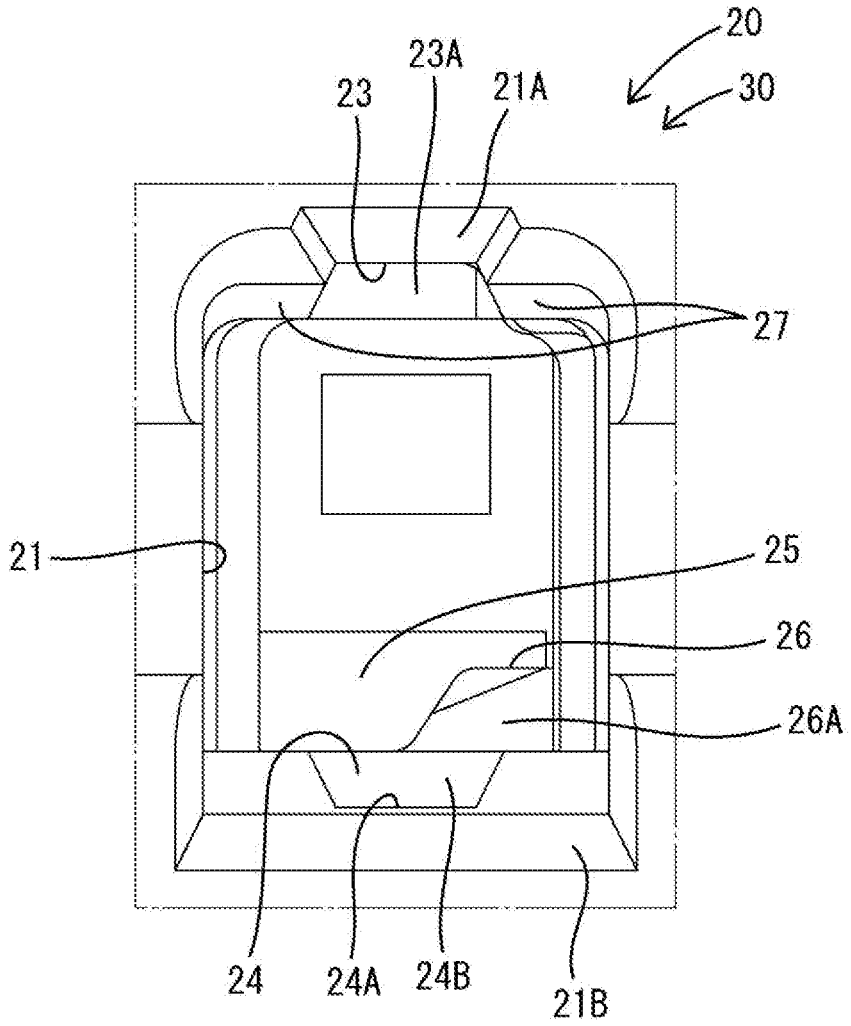
FIG. 2 is a back view of a cavity part in a housing.

As shown in FIGS. 2 and 3, the guide groove 23 communicates with the cavity 21 and extends in the front-rear direction in a laterally intermediate region of an upper surface of the cavity 21. The guide groove 23 has a substantially flat trapezoidal cross-sectional shape corresponding to the outer shape of a stabilizer 65 of the terminal fitting 60 and the rear end thereof makes a cutout in a guiding portion 21A. The front end of the guide groove 23 is closed by a closing surface 23A at a position slightly in front of the retainer fitting groove 20. As shown in FIG. 2, the housing body 30 is formed with upper wall surfaces (facing wall surfaces of the cavity 21) 27 continuous with both left and right sides of the guide groove 23.

As shown in FIG. 3, the step 24 is at a position forward from the rear surface of the cavity 21 and behind the retainer fitting groove 22 on the lower surface of the cavity 21. The step 24 has a varying height in the front-rear direction. As shown in FIGS. 2 and 3, the entrance groove 24A is open in a rear surface in a widthwise central part of the step 24. The entrance groove 24A has a substantially flat trapezoidal cross-section corresponding to the outer shape of the stabilizer 65 of the terminal fitting 60. The contact surface 24B closes the front end of the entrance groove 24A.

The locking lance 25 is cantilevered forward on a lower wall of the cavity 21 and projects into the cavity 21 for retaining and locking the terminal fitting 60. The locking lance 25 is resiliently deflectable in a direction retracting from the cavity 21.

A padded portion 26 is formed on one widthwise side of a base end part of the locking lance 25, as shown in FIGS. 2 and 3. The padded portion 26 is shaped so that a surface on the other side is linearly inclined toward the left and an upper surface is arranged along the lateral direction in a back view. The second contact surface 26A is formed on the rear surface of the padded portion 26. As shown in FIG. 3, the second contact surface 26A is reverse-tapered to be higher toward the rear.

As shown in FIG. 3, the front mask 40 is formed with accommodation recesses 41 communicating with the cavities 21. The retainer 50 is formed with protrusions 51 that enter openings 64 of the terminal fittings 60.

Figure 4:
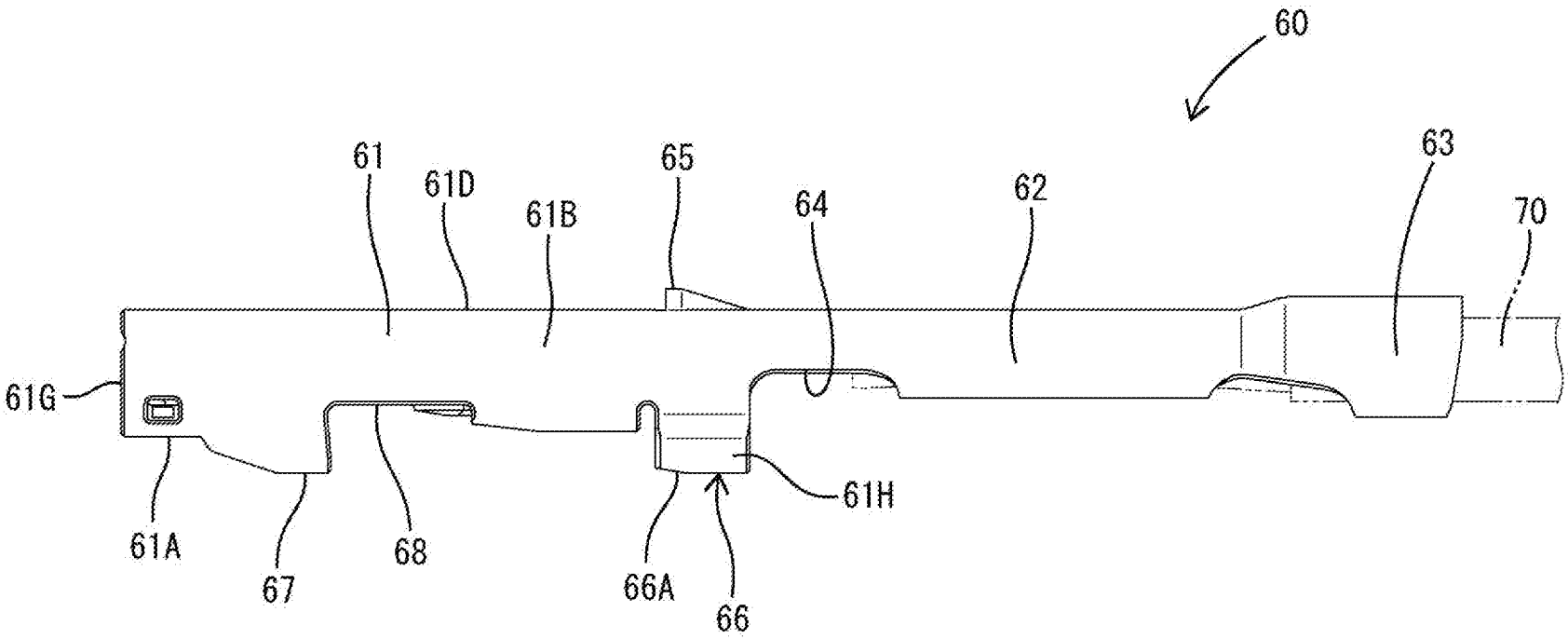
FIG. 4 is a right side view of a terminal fitting.
Figure 5:
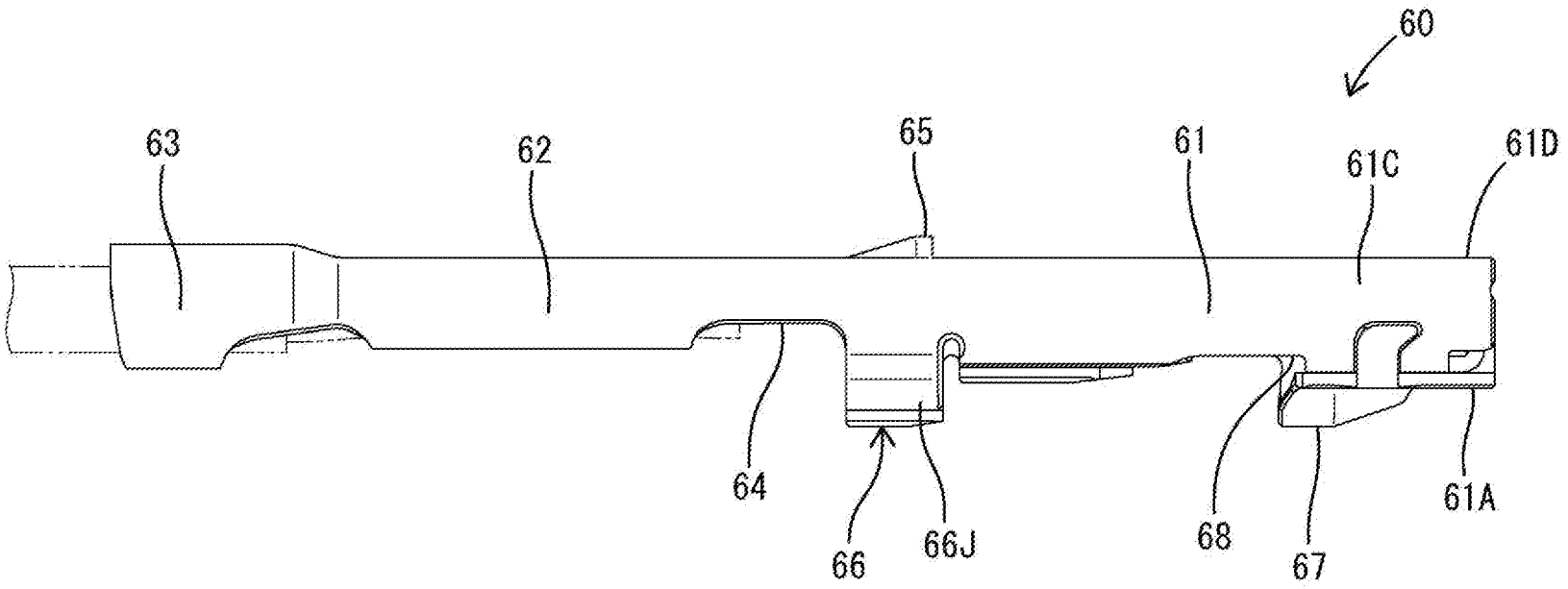
FIG. 5 is a left side view of the terminal fitting.
Figure 6:
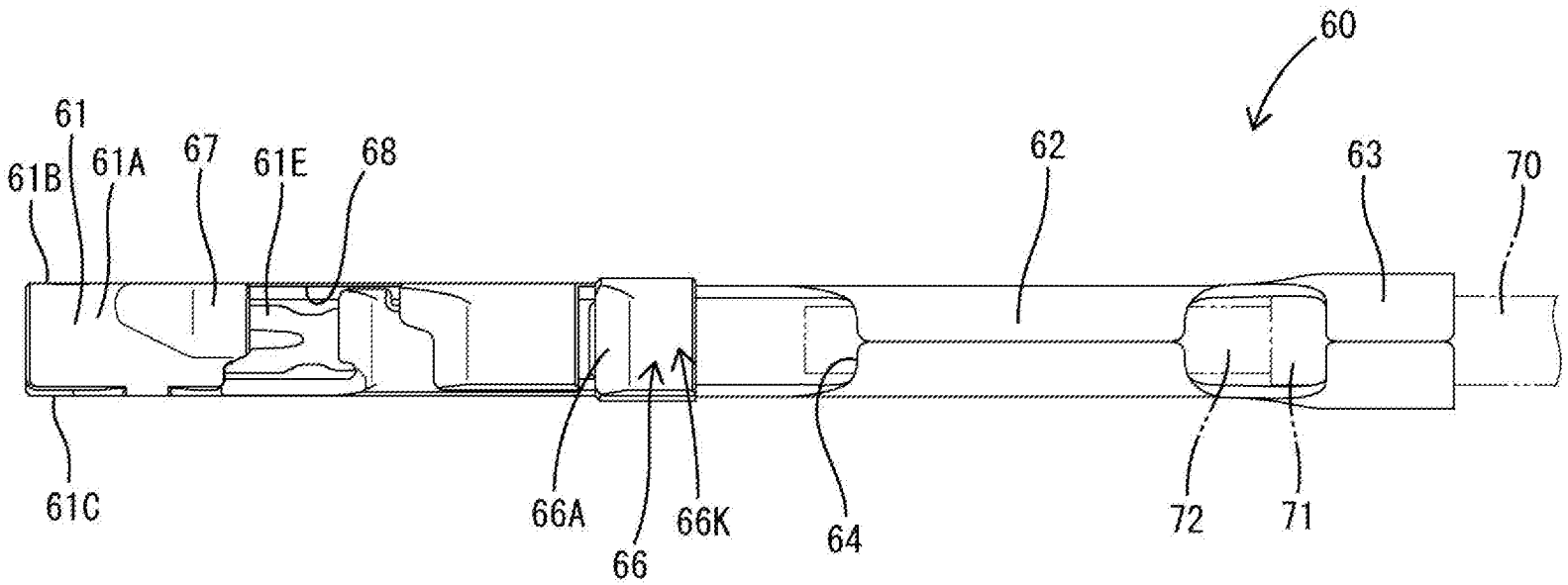
FIG. 6 is a bottom view of the terminal fitting.

As shown in FIGS. 4 to 8, the terminal fitting 60 is a female terminal fitting formed by bending a conductive metal plate that has been stamped into a predetermined shape. The terminal fitting 60 is elongated in the front-rear direction and includes a body 61, a wire barrel 62 located behind the body 61 and an insulation barrel 63 located behind the wire barrel 62. The wire barrel 62 and the insulation barrel 63 are open barrels that are crimped into connection with a coating 71 on an end part of a wire 70 and a core 72 exposed by removing the coating 71, as shown in FIG. 6. The opening 64 is formed forward of the wire barrel 62 by removing a wall of a lower part.

Figure 7:
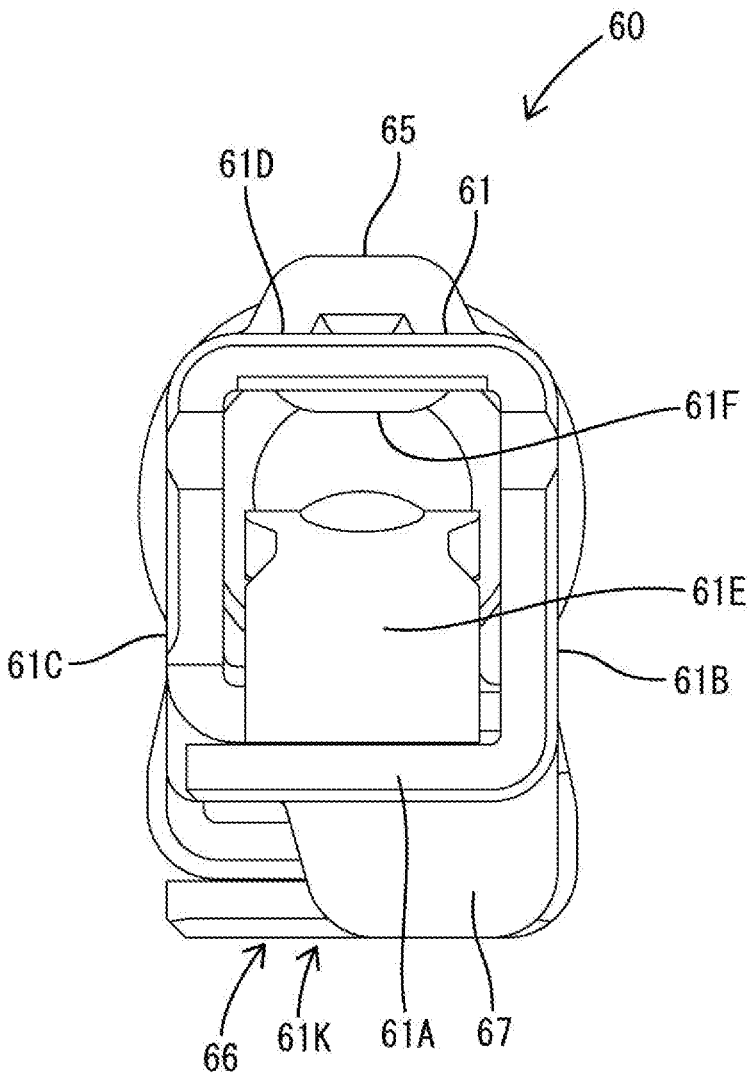
FIG. 7 is a front view of the terminal fitting.
Figure 8:
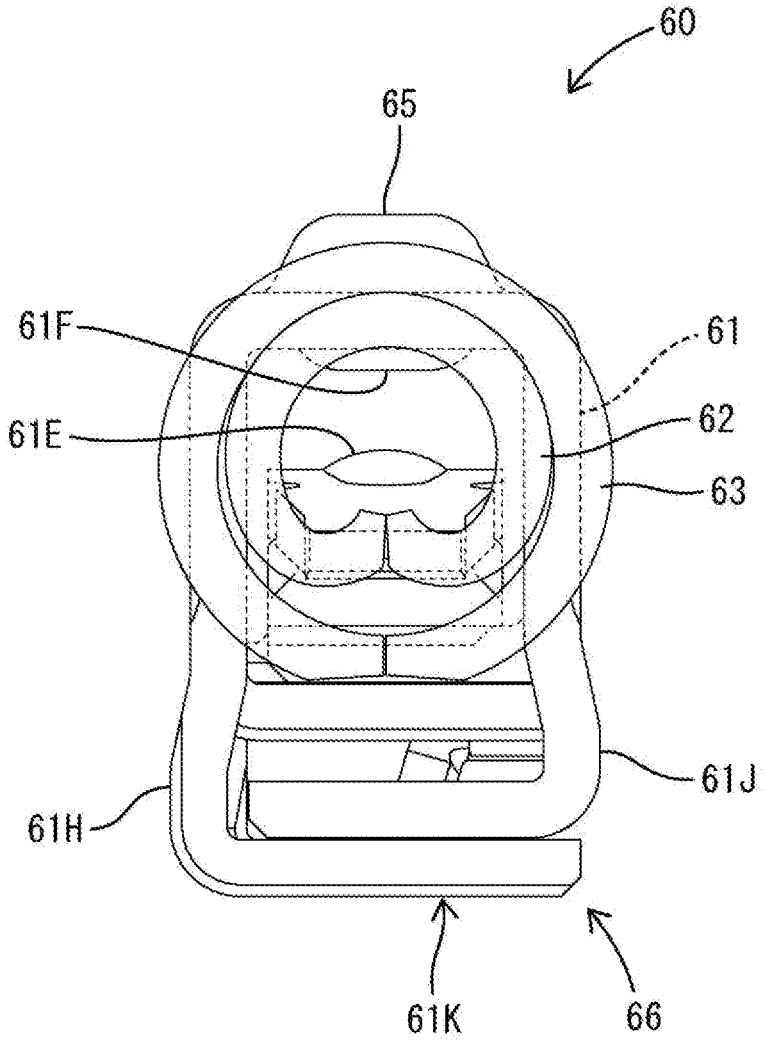
FIG. 8 is a back view of the terminal fitting.

As shown in FIGS. 7 and 8, the body 61 is in the form of a rectangular tube and includes a bottom plate 61A, two side plates 61B, 61C and a ceiling plate 61D. The bottom plate 61A is composed of two inner and outer (upper and lower) plates overlapping each other. As shown in FIGS. 7 and 8, the body 61 includes a deflectable and deformable resilient contact piece 61E and a receiving portion 61F inside. The resilient contact piece 61E is formed by rearwardly folding a tongue projecting from the bottom plate 61A. The receiving portion 61F bulges to be concave toward the bottom plate 61A. The receiving portion 61F faces the resilient contact piece 61E, and a male tab of an unillustrated mating terminal fitting is inserted between the receiving portion 61F and the resilient contact piece 61E. The terminal fittings are connected electrically by the contact of the male tab with the resilient contact piece 61E and the receiving portion 61F.

As shown in FIGS. 4, 5, 7 and 8, a cut is formed in a width direction in a laterally intermediate region of a rear end part of the ceiling plate 61D and this region is struck by a press from inside, thereby forming the stabilizer 65 bulging upward. As shown in FIG. 7, the stabilizer 65 has an outer shape as to be continuous in the width direction while having a substantially trapezoidal shape and connects an upper part and both left and right sides in a curved manner in a front view. As shown in FIGS. 4 and 5, the stabilizer 65 is shaped so that a front surface extends along the vertical direction, a rear surface is linearly inclined toward the rear and an upper surface extends along the front-rear direction in a side view.

As shown in FIG. 8, rear parts of the side plates 61B, 61C are configured as extending side walls 61H, 61J extending farther down than other parts. The extending side walls 61H, 61J are so disposed as to widen a spacing therebetween toward a lower side. A rear end part of a double overlapping part of the bottom plate portion 61A serves as a double wall 61K disposed further downward than the other double overlapping part via the extending side walls 61H, 61J. The double wall 61K is wider than the other double overlapping part. A first rattling preventing protrusion 66 is configured by the extending side walls 61H, 61J and the double wall 61K.

As shown in FIGS. 4 and 5, the first rattling preventing protrusion 66 is arranged on a surface of the body 61 opposite to the one where the stabilizer 65 is provided and at a position overlapping the stabilizer 65 in the front-rear direction. The first rattling preventing protrusion 66 is formed in the same range in the front-rear direction as the stabilizer 65 in the body 61. As shown in FIG. 6, the first rattling preventing protrusion 66 has a tapered portion 66A inclined to be higher toward the front and formed by striking.

As shown in FIGS. 4 to 6, the bottom plate 61A is formed with an opening 68 by having no wall in a lower part at a position near a front part of the body 61. A second rattling preventing protrusion 67 defines the front end of the opening 68. The second rattling preventing protrusion 67 is formed into a convex shape projecting down by being pressed outwardly. The second rattling preventing protrusion 67 is in front of and spaced from the first rattling preventing protrusion 66. As shown in FIGS. 4 and 5, the second rattling preventing protrusion 67 is shaped so that a front surface is linearly inclined toward the front, a rear surface is arranged along the vertical direction and an upper surface is arranged along the front-rear direction in a side view. As shown in FIGS. 6 and 7, a left side of the front surface of the second rattling preventing protrusion 67 is inclined to be higher toward the left.

Next, functions and effects of this embodiment are described.

First, a case where the terminal fitting 60 is mounted in a proper insertion posture into the housing 20 is described. In mounting the terminal fitting 60 into the housing 20, the retainer 50 is held at a partial locking position with respect to the housing body 30, as shown in FIG. 3. In that state, the terminal fitting 60 is inserted in the proper insertion posture into the cavity 21 of the housing body 30 from behind as shown in FIG. 9. In the process of inserting the terminal fitting 60 into the cavity 21, the stabilizer 65 enters the guide groove 23 to guide an insertion of the terminal fitting 60. In a final stage of inserting the terminal fitting 60 into the cavity 21, the second rattling preventing protrusion 67 interferes with the locking lance 25 to deflect and deform the locking lance 25 in the direction retracting from the cavity 21 (down).

When the terminal fitting 60 is inserted properly into the cavity 21, a front end 61G of the terminal fitting 60 is stopped in contact with the front end (bottom part) of the accommodation recess 41 and the locking lance 25 resiliently returns and is arranged to lock the rear end of the second rattling preventing protrusion 67, as shown in FIG. 9. By (primarily) locking the locking lance 25 to the second rattling preventing protrusion 67, the rearward escape of the terminal fitting 60 from the cavity 21 is restricted. The locking lance 25 is kept in a state avoiding interference with the bottom plate 61A by being located in the opening 68.

When the terminal fitting 60 is inserted properly into the cavity 21, the stabilizer 65 is near the closing surface 23A, as shown in FIG. 9, and the rattling preventing protrusion 66 is near the second contact surface 26A.

Subsequently, the retainer 50 is pushed up toward a full locking position, as shown in FIG. 9. The protrusion 51 of the retainer 50 enters the opening 64 and (secondarily) locks the terminal fitting 60. The retainer 60 is arranged to be lockable to the rear end of the first rattling preventing protrusion 66. In this way, the terminal fitting 60 is accommodated in the proper insertion posture in the housing 20.

Figure 10:
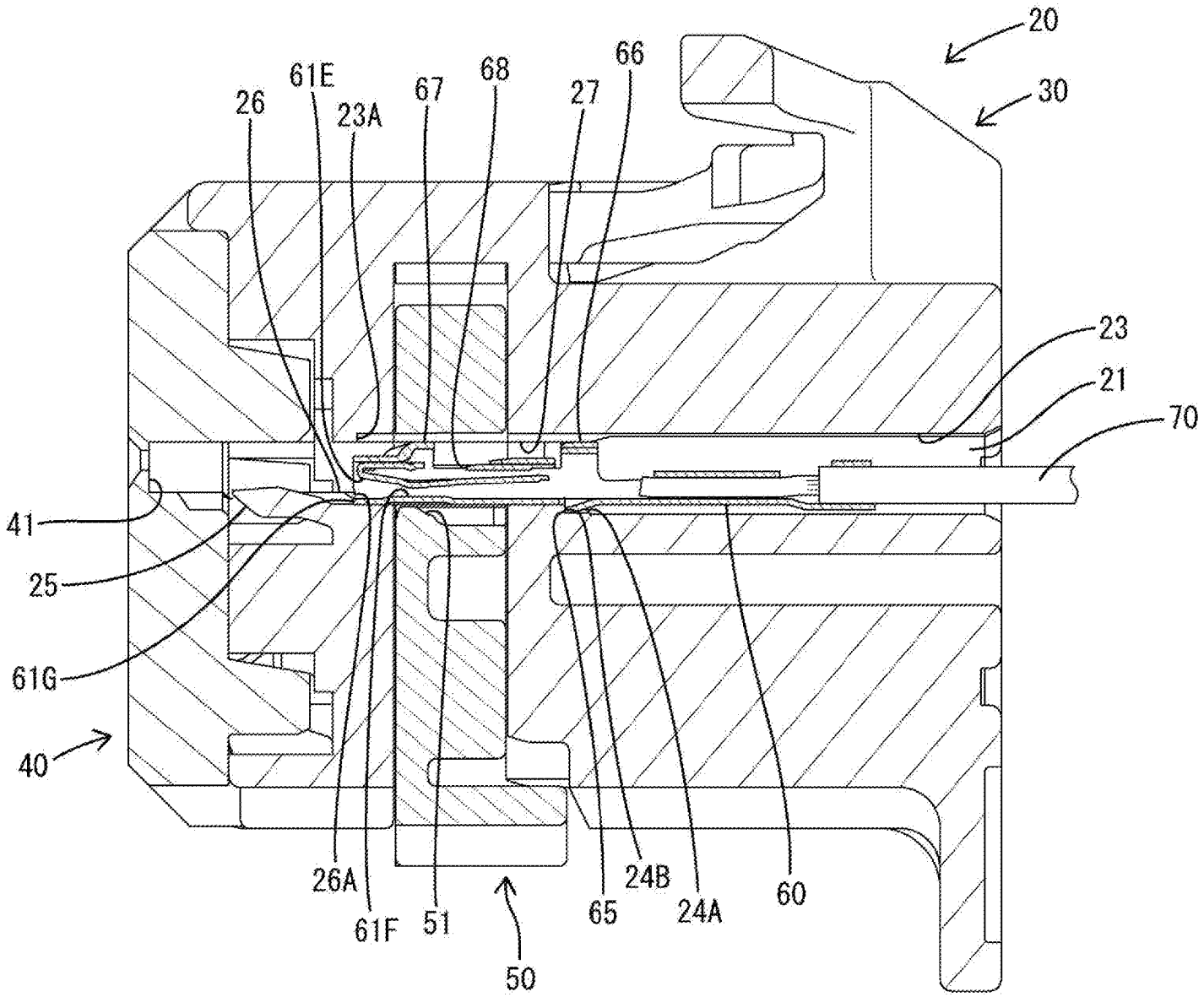
FIG. 10 is a right side view in section showing a state where the terminal fitting is inserted in an inverted insertion posture in the cavity.

Next, a case where an attempt is made to mount the terminal fitting 60 in an inverted insertion posture vertically opposite to the proper insertion posture into the housing 20 is described. With the retainer 50 held at the partial locking position with respect to the housing body 30, the terminal fitting 60 is inserted in the inverted insertion posture into the cavity 21 of the housing body 30 from behind, as shown in FIG. 10. In the process of inserting the terminal fitting 60 into the cavity 21, the stabilizer 65 enters the entrance groove 24A.

When the terminal fitting 60 is inserted up to a position near the front end of the cavity 21 (restricting position), as shown in FIG. 10, the front end 61G of the terminal fitting 60 is stopped in contact with the second contact surface 26A and, substantially simultaneously, the stabilizer 65 is stopped in contact with the first contact surface 24B. In this way, the stabilizer 65 restricts any further insertion of the terminal fitting 60. As just described, a forward movement of the terminal fitting 60 is restricted by the second contact surface 26A together with the contact surface 24B. Thus, the insertion of the terminal fitting 60 in the inverted insertion posture can be reliably prevented.

As shown in FIG. 10, the first rattling preventing protrusion 66 can come into contact with facing wall surfaces of the cavity 21 (pair of upper wall surfaces 27) with the terminal fitting 60 held in the inverted insertion posture and the stabilizer 65 held in contact with the first contact surface 24B. The rattling preventing protrusion 66 comes into surface contact with the pair of upper wall surfaces 27 along the front-rear direction, thereby acting to prevent the terminal fitting 60 from being inclined with respect to the front-rear direction in the cavity 21. Thus, a state where the stabilizer 65 is in contact with the contact surface 24B can be maintained and the inverted insertion of the terminal fitting 60 can be effectively restricted. Further, since the first rattling preventing protrusion 66 is arranged on the other surface of the body 61 opposite to one surface where the stabilizer 65 is arranged, it is not necessary to provide a part for preventing the inverted insertion on a surface different from those where the first rattling preventing protrusion 66 and the stabilizer 65 are arranged in the body 61 of the terminal fitting 60 and a size increase in a direction perpendicular to the front-rear direction can be prevented. Therefore, the connector 10 can effectively restrict the inverted insertion of the terminal fitting 60 into the housing 20 and realize miniaturization.

As shown in FIG. 10, the second rattling preventing protrusion 67 can come into contact with the facing wall surface of the cavity 21 (upper wall surface 27 on the left side) on a side in front of the first rattling preventing protrusion 66. Thus, the terminal fitting 60 further can be prevented from being inclined with respect to the front-rear direction in the cavity 21. In this way, if the front end 61G of the terminal fitting 60 is in contact with the lower surface of the cavity 21, such a state can be reliably maintained and the inverted insertion of the terminal fitting 60 can be restricted even more effectively. The second rattling preventing protrusion 67 has both a function of effectively restricting the inverted insertion of the terminal fitting 60 and a function of preventing the escape of the terminal fitting 60. Therefore, the configuration of the connector 10 can be simplified as compared to the case where such functions are respectively exhibited by different mechanisms.

The connector 10 insertion by the stabilizer 65 contacting the contact surface 24B if the terminal fitting 60 is in an inverted insertion posture. Further, with the terminal fitting 60 held in the inverted insertion posture and the stabilizer 65 held in contact with the contact surface 24B, the first rattling preventing protrusion 66 arranged on the second surface of the body 61 opposite to the first surface and at the position overlapping the stabilizer 65 in the front-rear direction can contact the upper wall surfaces 27 of the cavity 21. The rattling preventing protrusion 66 prevents the terminal fitting 60 from being inclined with respect to the front-rear direction in the cavity 21 by contacting the upper wall surfaces 27. Thus, the stabilizer 65 remains in contact with the contact surface 24, and the inverted insertion of the terminal fitting 60 can be restricted. Further, since the first rattling preventing protrusion 66 is arranged on the other surface of the body 61 opposite to the one surface where the stabilizer 65 is arranged, it is not necessary to provide a part for preventing the inverted insertion on a surface different from those where the first rattling preventing protrusion 66 and the stabilizer 65 are arranged in the body 61 of the terminal fitting 60 and a size increase in the direction perpendicular to the front-rear direction can be prevented. Therefore, the connector 10 can effectively restrict the inverted insertion of the terminal fitting 60 into the housing 20 and realize miniaturization.

The terminal fitting 60 has the second rattling preventing protrusion 67 in front of and spaced from the first rattling preventing protrusion 66 on the second surface of the body 61 and capable of contacting the facing upper wall surfaces 27 of the cavity 21 with the terminal fitting 60 held in the inverted insertion posture and the stabilizer 65 in contact with the contact surface 24B. Accordingly, the terminal fitting 60 contacts the upper wall surfaces 27 of the cavity 21 at positions different in the front-rear direction by the first and second rattling preventing protrusions 66 and 67. Thus, the terminal fitting 60 cannot incline with respect to the front-rear direction in the cavity 21. In this way, the state where the stabilizer 65 is in contact with the contact surface 24B is maintained reliably and the inverted insertion of the terminal fitting 60 is restricted even more effectively.

The housing 20 includes the locking lances 25 configured to retain and lock the terminal fittings 60 by deflectably projecting into the cavities 21. The second rattling preventing protrusion 67 can be retained and locked by the locking lance 25 if the terminal fitting 60 is in the proper insertion posture. According to this configuration, the second rattling preventing protrusion 67 has both the function of reliably restricting the inverted insertion of the terminal fitting 60 and the function of preventing the escape of the terminal fitting 60. Thus, the configuration of the connector 10 can be simplified as compared to the case where such functions are exhibited by different mechanisms.

The housing 20 has the second contact surface 26A capable of coming into contact with the front end 61G of the terminal fitting 60 if the terminal fitting 60 is in an inverted insertion posture. According to this configuration, the second contact surface 26A can contact the front end 61G of the terminal fitting 60 if the terminal fitting 60 is in the inverted insertion posture. Thus, a forward movement of the terminal fitting 60 can be restricted by the second contact surface 26A. Therefore, the connector 10 can reliably prevent the insertion of the terminal fitting 60 in the inverted insertion posture.

The invention is not limited to the above described embodiment. For example, the following embodiments also are included in the scope of the invention.

Although the closing surface 23A is provided in front of the retainer fitting groove 22 in the cavity 21 in the above embodiment, the closing surface 23A may be provided at a different position in the front-rear direction. Similarly, the contact surface 24B and the second contact surface 26A may be provided at positions different in the front-rear direction from those in the above embodiment.

In the above embodiment, the housing 20 may not include the front mask 40. In this case, the terminal fittings 60 may be retained by the front ends of the cavities 21.

Although the cavities 21 are aligned in the lateral direction in each of three stages divided in the vertical direction in the above embodiment, there is no limitation to such an arrangement.

In the above embodiment, the terminal fitting may be a male terminal fitting in which a tab projects forward from a body.

LIST OF REFERENCE SIGNS

10 . . . connector
20 . . . housing
21 . . . cavity
23 . . . guide groove
24A . . . entrance groove
24B . . . contact surface
25 . . . locking lance
26A . . . second contact surface
60 . . . terminal fitting
61G . . . front end of terminal fitting
65 . . . stabilizer
66 . . . first rattling preventing protrusion
67 . . . second rattling preventing protrusion

What is claimed is:

1. A connector, comprising a housing and a terminal fitting to be accommodated into the housing, wherein:

the housing includes:

a cavity extending in a front-rear direction, the cavity having opposite first and second surfaces, the terminal fitting being inserted into the cavity;

a guide groove formed in the first surface of the cavity and extending in the front-rear direction; and a stepped contact surface formed on the second surface of the cavity and a padded portion on the second surface of the housing forward of the stepped contact surface; and the terminal fitting includes:

a stabilizer arranged on a first surface of a body and configured to enter the guide groove if the terminal fitting is in a proper insertion posture, while restricting insertion by contacting the contact surface if the terminal fitting is in an inverted insertion posture opposite to the proper insertion posture; and a rattling preventing protrusion arranged on a second surface of the body opposite to the first surface and at a position overlapping the stabilizer in the front-rear direction and capable of contacting a facing wall surface of the cavity with the terminal fitting held in the inverted insertion posture and the stabilizer held in contact with the contact surface, the rattling preventing protrusion being opposed to the padded portion when the terminal fitting is inserted in the proper posture to prevent ratting transverse to the front-rear direction.

2. The connector of claim 1, wherein the rattling preventing protrusion is a first rattling preventing protrusion and the terminal fitting further includes a second rattling preventing protrusion arranged in front of and spaced from the first rattling preventing protrusion on the second surface of the body and capable of contacting the facing wall surface of the cavity with the terminal fitting held in the inverted insertion posture and the stabilizer held in contact with the contact surface.

3. The connector of claim 2, wherein:

the housing includes a deflectable locking lance projecting into the cavity from the second surface of the cavity and configured to retain and lock the terminal fitting; and the second rattling preventing protrusion is retainable and lockable by the locking lance if the terminal fitting is in the proper insertion posture.

4. The connector of claim 3, wherein the housing has a second contact surface disposed and configured to contact a front end of the terminal fitting if the terminal fitting is in the inverted insertion posture.

5. The connector of claim 1, wherein the housing has a second contact surface disposed and configured to contact a front end of the terminal fitting if the terminal fitting is in the inverted insertion posture.

6. The connector of claim 1, wherein the rattling preventing protrusion has a width measured transverse to the front-rear direction that exceeds a width of the guide groove measured transverse to the front-rear direction.

7. The connector of claim 1, wherein all of the stabilizer is defined in a range defined by the rattling preventing protrusion in the front-rear direction.

8. The connector of claim 1, wherein the body of the terminal fitting has opposite first and second side walls, the rattling preventing protrusion being bent from the first side and extending toward the second side wall.

9. The connector of claim 1, wherein the body of the terminal fitting has opposite first and second side walls, the rattling preventing protrusion has first and second portions bent respectively from the first and second side walls, the first and second portions of the rattling preventing protrusion being overlapped with one another.

10. The connector of claim 1, wherein the housing includes a locking lance projecting from the second surface of the cavity, the rattling preventing protrusion being at a position spaced rearward of the locking lance when the terminal fitting is inserted in the proper posture and when the terminal fitting is inserted in the improper posture.

11. The connector of claim 1, further comprising a retainer mountable into the body in a direction transverse to the front-rear direction, the retainer engaging a rear end of the rattling preventing protrusion when the terminal fitting is inserted in the proper posture for preventing withdrawal of the terminal fitting from the housing.

12. The connector of claim 1, wherein the guide groove of the housing has a closing surface at a front end of the guide groove, the stabilizer contacting the closing surface of the guide groove when the terminal fitting is inserted in the proper posture.

13. The connector of claim 2, wherein the first and second rattling preventing protrusions have widths measured transverse to the front-rear direction, the width of the first and second rattling preventing protrusions exceeding a width of the guide groove measured transverse to the front-rear direction.

14. The connector of claim 2, further comprising a retainer mountable into the body in a direction transverse to the front-rear direction, the retainer engaging a rear end of the first rattling preventing protrusion when the terminal fitting is inserted in the proper posture for preventing withdrawal of the terminal fitting from the housing.

* * * * *